US005634839A

United States Patent [19]

Dixon

[11] Patent Number: 5,634,839

[45] Date of Patent: Jun. 3, 1997

[54] TOY AIRCRAFT AND METHOD FOR REMOTELY CONTROLLING SAME

[75] Inventor: Donald Dixon, 2282 Plumgrove, West Bloomfield, Mich. 48324

[73] Assignee: Donald Dixon, West Bloomfield, Mich.

[21] Appl. No.: 344,288

[22] Filed: Nov. 23, 1994

[51] Int. Cl.[6] ..... A63H 27/127; A63H 27/00

[52] U.S. Cl. ..... 446/37; 446/57

[58] Field of Search ..... 446/34, 36, 37, 446/44, 45, 46, 47, 48, 57, 58, 59, 60, 456, 484; 244/17.23, 17.21, 17.19

[56] References Cited

U.S. PATENT DOCUMENTS

| | | | |
|---|---|---|---|
| D. 169,558 | 5/1953 | Nagler | 446/36 X |
| 1,528,943 | 3/1925 | Naranjo . | |
| 1,554,065 | 9/1925 | Blair . | |
| 1,632,179 | 6/1927 | Foerster . | |
| 1,697,009 | 1/1929 | Isacco . | |
| 1,923,973 | 8/1933 | Gudorf et al. | 244/8 X |
| 2,457,281 | 12/1948 | Shannon | 446/57 |
| 2,638,707 | 5/1953 | Baker . | |
| 2,673,696 | 3/1954 | Pullin et al. . | |
| 2,816,764 | 12/1957 | Gleason . | |
| 2,917,255 | 12/1959 | Boyd . | |
| 2,949,693 | 8/1960 | McRoskey . | |
| 3,010,678 | 11/1961 | Gose . | |
| 3,013,746 | 12/1961 | Siebenthal . | |
| 3,176,413 | 4/1965 | Dornier et al. . | |
| 3,181,816 | 5/1965 | Pfleiderer . | |
| 3,246,861 | 4/1966 | Curci | 244/17.23 X |
| 3,394,906 | 7/1968 | Rogers . | |
| 3,565,434 | 2/1971 | Liston | 273/426 |
| 3,662,487 | 5/1972 | Seefluth . | |
| 3,721,403 | 3/1973 | Gray et al. | 244/7 A |
| 3,762,669 | 10/1973 | Curci | 244/17.23 |
| 3,786,246 | 1/1974 | Johnson et al. . | |
| 3,814,431 | 6/1974 | Callahan . | |
| 3,858,872 | 1/1975 | Summerfield et al. | 446/230 X |
| 3,881,729 | 5/1975 | Block et al. . | |
| 3,937,424 | 2/1976 | Meier et al. . | |
| 3,955,817 | 5/1976 | Davis . | |
| 4,135,324 | 1/1979 | Miller et al. . | |
| 4,184,654 | 1/1980 | Herrera . | |
| 4,891,029 | 1/1990 | Hutchinson . | |
| 4,975,022 | 12/1990 | Perry . | |
| 5,030,157 | 7/1991 | Silverglate . | |
| 5,045,013 | 9/1991 | Fujitani | 446/57 X |
| 5,080,624 | 1/1992 | Brinker | 446/36 X |
| 5,297,759 | 3/1994 | Tilbor et al. . | |
| 5,319,531 | 6/1994 | Kutnyak . | |

FOREIGN PATENT DOCUMENTS

| | | | |
|---|---|---|---|
| 2707517 | 1/1995 | France | 446/37 |
| 1326652 | 8/1973 | United Kingdom | 244/7 A |

*Primary Examiner*—Robert A. Hafer
*Assistant Examiner*—D. Neal Muir
*Attorney, Agent, or Firm*—Harness, Dickey & Pierce, P.L.C.

[57] ABSTRACT

A toy aircraft includes a main body portion having a central hub member and a plurality of wings. Each wing of the plurality of wings is equally spaced about a central axis of rotation. The toy aircraft further includes a power source carried by the aircraft, at least one motorized propulsion unit interconnected with the power source, and at least first and second propeller assemblies interconnected to the at least one motorized propulsion unit. The first and second propeller assemblies each include a plurality of blades arranged for rotation within a substantially horizontal plane. A preferred construction of the propellers includes a propeller shaft and a plurality of blade portions equally spaced about an axis of rotation defined by the propeller shaft. Each blade portion is formed from foamed polystyrene. A preferred construction of a control system for controlling the flight of the toy aircraft includes a handheld remote control unit and a receiver circuit positioned on the toy aircraft.

28 Claims, 5 Drawing Sheets

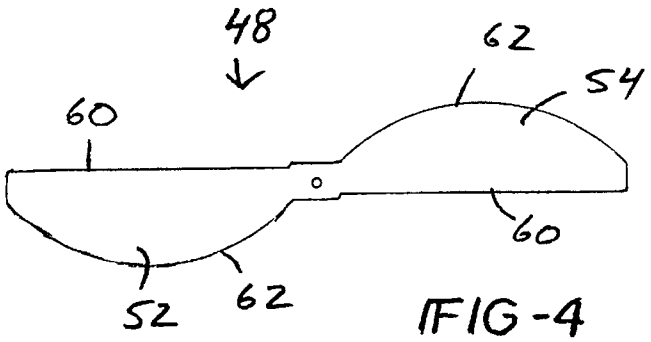
FIG-4
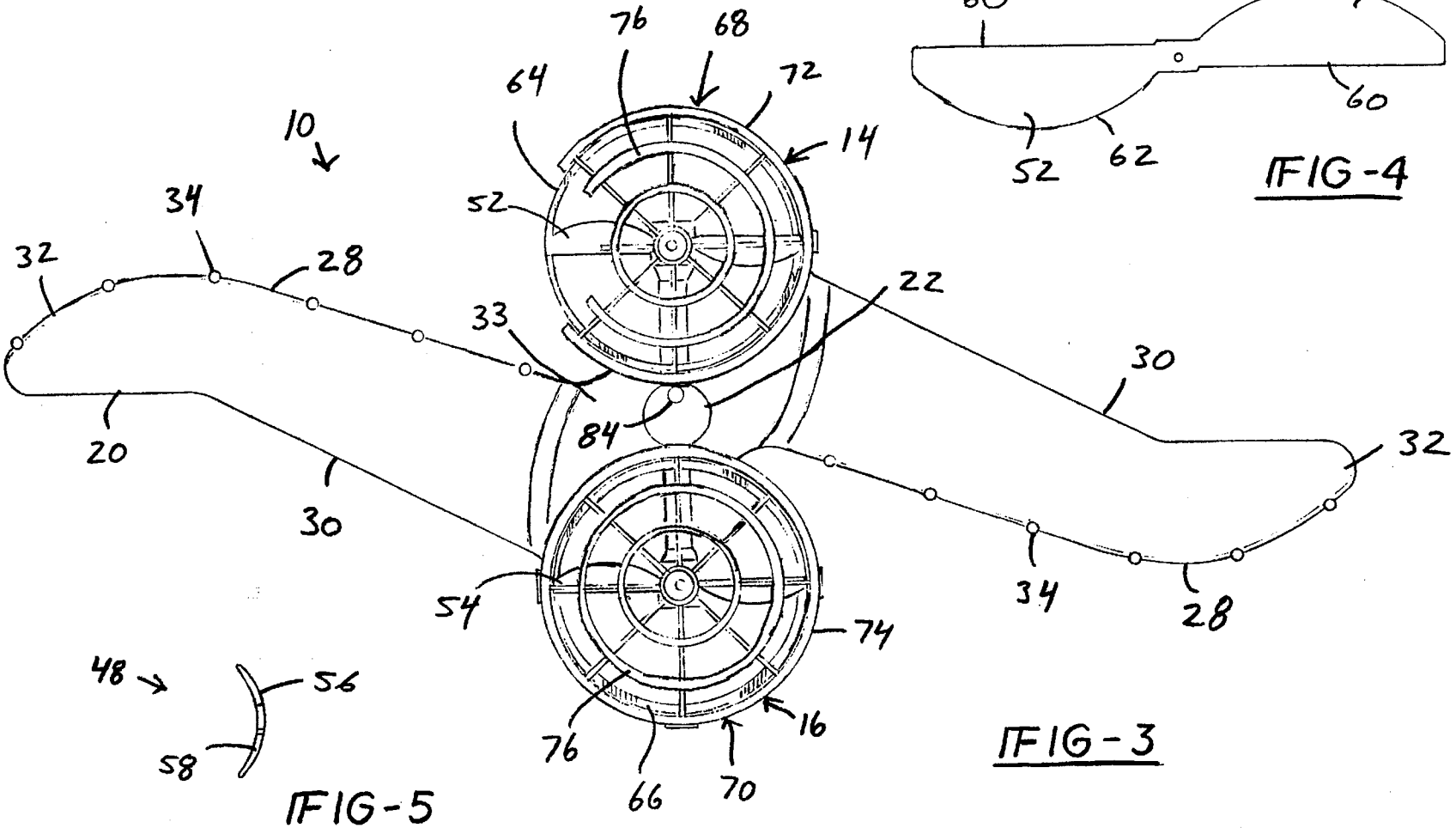
FIG-3
FIG-5

TOY AIRCRAFT AND METHOD FOR REMOTELY CONTROLLING SAME

BACKGROUND AND SUMMARY OF THE INVENTION

The present invention relates in general to an aerodynamic structure. More particularly, the present invention relates to a flying saucer-type toy aircraft and a method of controlling a flying saucer-type aircraft in untethered flight.

The recreational use of flying toys has long fascinated both children and adults. In their most simple form, flying toys include gliders, flying discs, boomerangs and like devices adapted for extended flight which can be powered by the toss or throw of a user. Gliders rely on lift created by a pair of wings for extended flight. In the case of flying discs or boomerangs, a spinning motion imparts an increased degree of aerodynamic stability, resulting in extended flight of the toy. More specifically, substantial flight distances are possible as a result of the total mass, peripheral mass distribution and solid, rigid construction which contribute to high angular momentum during flight. Flying discs were made popular under the trademark "Frisbee™". Frisbee brand flying discs are sold by the Wham-O Manufacturing Company and described in U.S. Pat. No. 3,359,678. Other similar discs or boomerang-type flying toys are shown and described in U.S. Pat. Nos. 2,816,764, 3,881,729 and 5,030,157.

More sophisticated prior known flying toys include powered aircraft. Typically powered aircraft include miniature airplanes, helicopters and rockets. Miniature rockets typically include a gun powder charge ignitable to upwardly propel the craft. Toy airplanes and helicopters are generally powered by miniature or toy internal combustion engines. Examples of miniature airplanes and helicopters are shown and described in U.S. Pat. Nos. 2,638,708 and 3,181,816.

Also heretofore known are flying saucer-type toys incorporating one or more motor driven propellers. Illustrative examples of such toys are disclosed in U.S. Pat. Nos. 2,949,693 and 3,394,906.

While prior known devices have proven to be entertaining and relatively commercially successful, none are without their drawbacks or inherent limitations. For example, most devices suitable for sustained flight require a large area for safe operation. Many other known devices do not include sufficient stability for controlled flight. Other known devices are expensive in construction and readily subject to failure or breakage. Still other devices do not return to the ground under control or do not return to the user. Many of the foregoing characteristics of flying toys are generally unsuitable for children.

It is an object of the present invention to provide a different type of toy aircraft which is powered by a miniature or toy engine or motor, but which is novel both in its structure and in its flight characteristics.

Another object of the present invention is to provide a toy aircraft which will fly substantially straight upwardly under power and which can be remotely controlled through untethered flight.

Yet another object of the present invention is to provide a toy aircraft of dual wing construction including a power source for generating vertical lift through creation of a downward air force and gyroscopic rotation of the wings about a central axis.

Still yet another object of the present invention is to provide a toy aircraft of a construction having a high angular momentum during flight.

It is a further object of the present invention to provide a toy aircraft which will fly substantially straight upwardly under power unless directed otherwise and which will float slowly back down to the ground after its fuel has been exhausted.

Still a further object of the present invention is to provide an aircraft having one or more propellers constructed of foamed polystyrene so as to decrease the amount of fuel necessary to rotate the propellers and thereby extend flight of the aircraft.

In a first aspect, the present invention is a toy aircraft including a main body portion having a central hub and a plurality of wings. Each wing of the plurality of wings is equally spaced out a central axis of rotation. The toy aircraft further includes a power source which is carried by the aircraft and at least one motorized propulsion unit interconnected with the power source. The toy air craft additionally includes first and second propeller assemblies interconnected to the at least one motorized propulsion unit. The first and second propeller assemblies each include a plurality of blades arranged for rotation. Rotation of the blades of the first and second propeller assemblies provides a primary source of lift to the aircraft directly from air displaced by the blades and a secondary of lift to the aircraft from the angular momentum of the blades which causes rotation of the main body portion about the central axis of rotation.

In a second aspect, the present invention is a propeller assembly for providing a source of lift for a toy aircraft. The propeller assembly includes a propeller shaft and a plurality of blade portions equally spaced about and axis of rotation defined by the propeller shaft. Each blade portion is formed from foamed polystyrene.

In a third aspect, the present invention is a control system for controlling the flight of a toy aircraft of the type propelled by at least one propulsion unit. The control system includes a remote control unit having a plurality of function switches. The remote control unit also includes a control circuit operable to generate a plurality of modulated signals. A first control signal is an ascent control signal, a second control signal is a descent control signal and a third control signal is a directional control signal. A choice in one of the plurality of function switches causes the control circuit to generate one of the first, second or third control signals. The control system further includes a receiver circuit position on the toy aircraft. The receiver circuit is responsive to the control signals from the control unit, and causes at least one propulsion unit to operate in a predetermined manner to control the flight of the aircraft, depending on which of the first, second or third control signals is received by the receiver unit.

BRIEF DESCRIPTION OF THE DRAWINGS

Further objects, features and advantages of the present invention will become apparent from analysis of the following written specification and the accompanying drawing and the appended claims in which:

FIG. 3 is a top plan view of the toy aircraft of FIG. 1;

FIG. 4 is a bottom plan view of a propeller used to generate lift for the toy aircraft of FIG. 1;

FIG. 5 is an end view of the propeller of FIG. 4;

DETAILED DESCRIPTION OF THE PREFERRED EMBODIMENT

Figure 1:
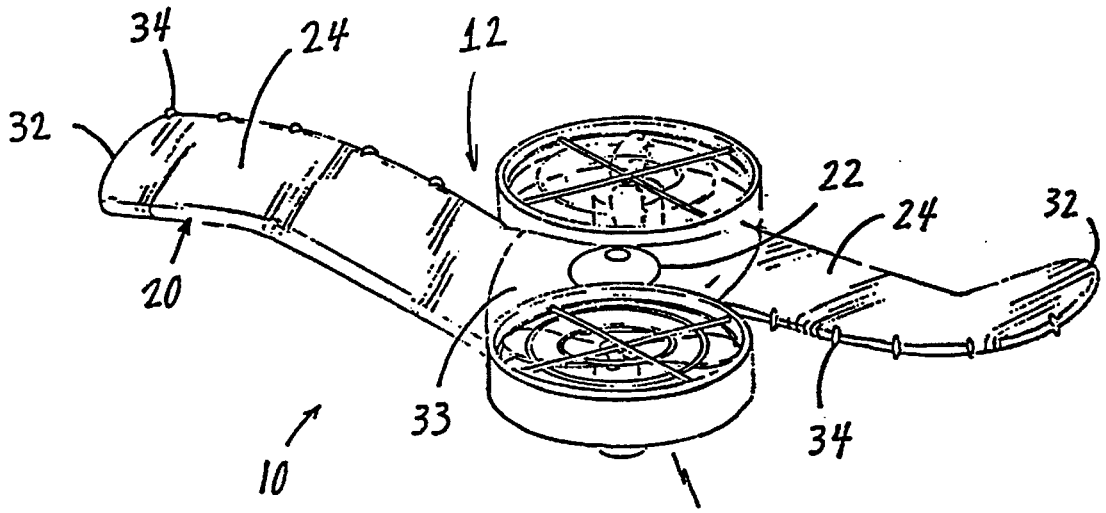
FIG. 1 is a top and side perspective view of the first embodiment of a toy aircraft constructed in accordance with a preferred embodiment shown being remotely controlled by a user.

Certain terminology is used in the following description for convenience only and is not intended to be limiting. The words "clockwise" and "counterclockwise" designate directions in the drawings to which reference is being made. Also in the drawings, where similar reference characters designate like parts throughout the several views, illustrated is a preferred embodiment of the present invention. More specifically, reference numeral 10 generally denotes a flying saucer type toy aircraft constructed in accordance with the teachings of the present invention that is configured for untethered flight.

Figure 2:
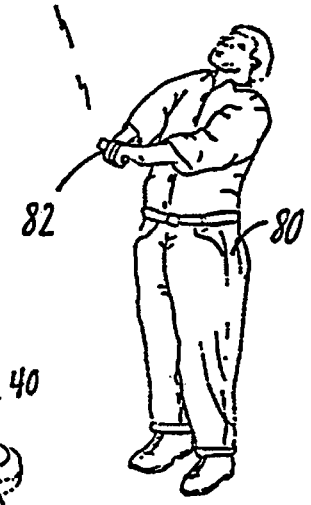
FIG. 2 is a side plan view of the toy aircraft of FIG. 1.
Figure 2:
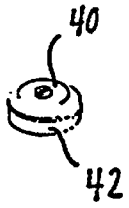
Figure 2:
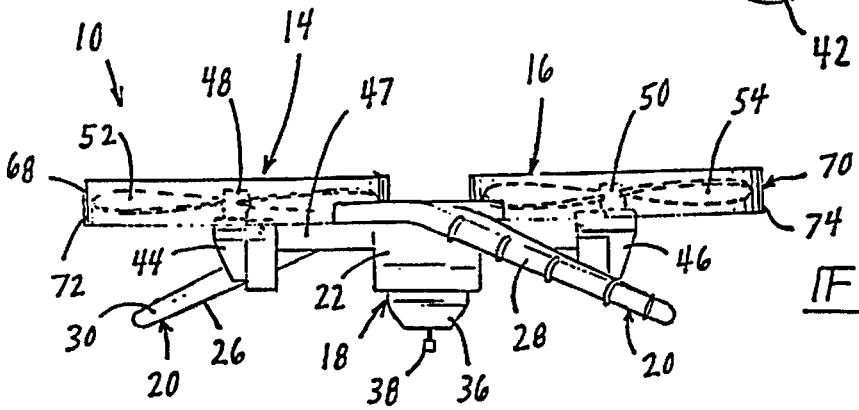

FIGS. 1–3 show a series of views of the aircraft 10. Particularly, FIG. 1 shows the aircraft 10 in flight, FIG. 2 shows a side view of the aircraft 10, and FIG. 3 shows a top view of the aircraft 10. The aircraft 10 preferably includes an aircraft body 12, a first motorized propulsion unit 14, a second motorized propulsion unit 16 and a power source 18. The body 12 includes a plurality of wings 20 extending from a central hub 22. In the illustrated embodiment shown throughout the drawings, the aircraft 10 includes two wings 20. However, it will be appreciated by those skilled in the art that the aircraft 10 can be modified to incorporate three or more wings 20 spaced about the central hub 22. Preferably, each wing 20 extends radially from and is equilangularly spaced about the central hub 22. In practice, the wings 20 are secured to the central hub 22 by adhesive, bolts or any other technique well known in the art. However, it will be appreciated by those skilled in the art that the entire body 12, including the hub 22 and the wings 20, may alternatively be formed as an integral unit which is molded of plastic or other suitable lightweight material. It is preferred that the aircraft 10 be constructed of lightweight, resilient flexible material including, but not limited to, solid and/or foamed plastics, balsa wood and or other lightweight woods, fiberglass or other composite material. Injection-molded polymer foam is currently preferred for the wings 20 due to its relatively low cost, light weight, strength and flexible resilience.

Each of the wings 20 includes a substantially airfoil shape having a convex upper surface 24 and a concave under surface 26. Additionally, each of the wings 20 includes a leading edge 28 and a trailing edge 30. By this description, it is apparent that the aircraft 10 will rotate in a clockwise direction about a central axis extending through the center of the hub 22. A tip portion 32 of each wing 20 is angled at approximately 30° with respect to a longitudinal centerline of the wing 20.

As shown in the exemplary embodiment, the longitudinal axes of the two wings 20 are mounted in a substantially parallel relationship on diametrically opposed sides of the hub 22. As shown most clearly in FIG. 2, the trailing edge 30 of each wing 20 is canted downwardly approximately 35°–45° from a generally horizontal plane. In the preferred embodiment illustrated throughout the drawings, the wings 20 are integrally formed so as to be interconnected by an intermediate portion 33. It will be appreciated by those skilled in the art that the wings 20 can alternatively be formed independently.

Alternatively, each of the wings 20 can be pivotally mounted to the hub 22 and servo motors (not shown) can be incorporated to independently vary the angle of the wings 20. As will be appreciated by those skilled in the art, small angular adjustments to one or both of the wings 20 will serve to vary the lift imparted to the aircraft 10 or the direction of flight without adjusting the speed of the motorized propulsion units 14 and 16.

Each wing 20 includes a series of light emitting diodes (LEDs) 34 extending along the leading edge 28. The LEDs 34 are electrically connected to each other and to the power source 18 through the central hub 22. A control circuit or microprocessor (discussed below) is housed within the central hub 22 to control the operation of the LEDs 34. In this manner, the LEDs 34 can be controlled in any desirable manner, such as independently illuminated, simultaneously illuminated, or illuminated in a preprogrammed sequence. Rotation of the aircraft 10 in flight and the simultaneous illumination of the LEDs 34 provides an appearance of a flying disc or UFO.

As shown in FIGS. 1–3, the central hub 22 is generally cylindrical and extends through the intermediate portion 33 of the body 12. It will be appreciated by those skilled in the art that the hub 22 can alternatively be circular, square or of any other geometry symmetrical on opposite sides of the central axis. The hub 22 further includes a removable cover 36 for providing access to the power source 18. The cover 36 can be attached to the hub 22 in any of a number of manners well known in the art. Injection molded plastic is the preferred material of choice for the hub 22. However, any of a number of suitable materials may be incorporated, including but not limited, to styrofoam, metal, cardboard and the like.

The power source 18 which is a centrally balanced power source, is a conventional rechargeable battery or pack of several batteries (not shown). However, it will be readily appreciated by those skilled in the art that the present invention could readily incorporate one or more gas powered micro-engines and a fuel tank. Also, the aircraft 10 can be alternatively powered by rubber bands or pull strings as known by those skilled in the art. In the exemplary embodiment, the power source 18 comprises six (6) 1.25 volt rechargeable, nickel-cadmium storage batteries. The power source 18 includes an electrical plug 38 that passes through the cover 36 of the hub 22 and is electrically connected with the power source 18 so as to provide a recharging connection. The electrical plug 38 mates with an electrical socket 40 associated with a charging unit 42 so the power source 18 can be recharged between flights of the aircraft 10. Alternatively, conventional batteries, such as alkaline type batteries, can be used as the power source to power the aircraft 10. The charging unit 42 preferably includes six to eight D-cell batteries (not shown) for sufficiently charging the power supply 18 of the aircraft 10. The power source 18 provides all power requirements of the aircraft 10.

The motorized propulsion unit 14 includes an electric motor 44 and the motorized propulsion unit 16 includes an electric motor 46. The electric motors 44 and 46 receive DC power from the batteries of the power source 18. The electric motors 44 and 46 are preferably variable speed motors selectively operable at least at a low speed and a high speed. A suitable electric motor is commercially available from Sun Motor Manufacturing, Ltd., China as Part No. 3530-38RC.

A longitudinally elongated housing 47 (shown in FIG. 2) intersects the central hub 22. The motors 44 and 46 are mounted at opposite ends of the elongated housing 47 as shown. As is known in the art, the motors 44 and 46 are electrically connected to the power source 18 through wires disposed within the elongated housing 47. Each of the motors 44 and 46 are connected to a drive shaft (not shown) that extends generally vertically along the longitudinal axis of the respective motor. Secured to an upper end of the drive shaft for the motor 44 is a propeller 48, and secured to an upper end of the drive shaft of the motor 46 is a propeller 50.

Each of the propellers 48 and 50 include two propeller blades 52 and 54, respectively, equilangularly spaced about an axis defined by the respective drive shaft. FIG. 4 shows a bottom view of one of the propellers 48 and 50, here propeller 48, and FIG. 5 shows an end view of the propeller 48. In the embodiment illustrated, the motors 44 and 46 are operable for rotating their respective shafts in a counterclockwise direction. The pitch of the blades 52 and 54 is in a counterclockwise direction so as to cause the propellers 48 and 50 to draw air downwardly. Each propeller blade 52 and 54 of the propellers 48 and 50 includes a convex upper surface 56 a concave lower surface 58, a generally linear leading edge 60, are a generally arcuate trailing edge 62. As a result of rotation, the propellers 48 and 50 lift the aircraft 10 vertically relative to the ground due to the simultaneous creation of a partial vacuum above the aircraft 10 and a high pressure column below the aircraft 10.

Further in the preferred embodiment, the propellers 48 and 50 are unitarily constructed of foamed polystyrene, such as is commercial recognized as styrofoam. The relatively light weight of styrofoam serves to lower the amount of energy necessary to upwardly propel the aircraft 10, and thereby lengthens the flight time for a single charge of the power supply 18. It will be appreciated by those skilled in the art that the present invention could alternatively incorporate a single motor. In such an alternative design, the single motor can be centrally mounted on the aircraft 10 and coupled to multiple propellers through a conventional arrangement of shafts and bevel gears.

The gyroscopic effect of the counterclockwise rotation of the propellers 48 and 50 results in a clockwise rotation of the body 12. The clockwise direction of the body 12 provides stability to the aircraft 10 during its powered flight. In addition to the lift provided by the propellers 48 and 50, the airfoil shape of the wings 20 utilize the rotation of the body 12 to create a secondary source of lift for the aircraft 10. While the rotation of the wings 20 provides a substantial source of lift, it should be appreciated that the primary source of lift is provided by the rotation of the propellers 48 and 50. It will be appreciated by those skilled in the art that the propellers 48 and 50 can alternatively be designed for clockwise rotation. In such an arrangement, the gyroscopic effect of the propeller rotation would cause the aircraft 10 to rotate in a counterclockwise direction.

The propellers 48 and 50 each preferably include an arcuate ring peripherally interconnecting the propeller blades 52 and 54. In the embodiment as shown, the propeller 48 includes an arcuate ring 64 and the propeller 50 includes an arcuate ring 66. The additional mass provided by the arcuate rings 64 and 66 serves to increase the angular momentum which results from rotation of the propellers 48 and 50. Preferably, the arcuate rings 64 and 66 are constructed of foamed polystyrene and are integrally formed with the respective propeller 48 and 50. However it will be appreciated by those skilled in the art that the arcuate rings 64 and 66 can alternatively be formed from a heavier material to even further measure the angular momentum produced by rotation of the propellers 48 and 50. As a result, the gyroscopic effects of the rotating propellers 48 and 50 increases, thereby correspondingly increasing the speed of clockwise rotation of the body 12 and imparting increased stability to the aircraft 10.

The propellers 48 and 50 are preferably enclosed within a protective cage. For the embodiment as shown, the propeller 48 is enclosed within a cage 68 and the propeller 50 is enclosed within a cage 70. The protective cages 68 and 70 are designed to reduce occurrences of inadvertent contact with the rotating blades of the propellers 48 and 50. As a result, the blades of the propellers 48 and 50 are protected from premature breakage. The protective cages 68 and 70 include side panels 72 and 74, respectively, that completely enclose the sides of the propellers 48 and 50 as shown. However, the protective cages 68 and 70 include a grate structure 76 at the bottom and top so as to be open to air flow from the bottom of the propellers 48 and 50 through the top of the propellers 48 and 50. Also, the protective cages 68 and 70 are attached at their undersides to the elongated housing 47. Alternatively, the protective cages 68 and 70 can be attached to a housing of the respective propulsion unit 14 and 16.

After the power source 18 is charged and the motorized propulsion units 14 and 16 are activated, rotation of the propellers 48 and 50 provides immediate lift to cause the aircraft 10 to ascend. The substantially immediate lift and rotation of the aircraft 10 provided by the propellers 48 and 50 of the motorized propulsion units 14 and 16 allows the aircraft 10 to be launched without a launching pad. Simultaneously with this vertical movement of the aircraft 10, the body 12 will be rotated in a clockwise direction by the counter torque resulting from the counterclockwise rotation of the propellers 48 and 50. The clockwise rotation of the body 12 will cause the upwardly canted wings 20 to engage air on their lower downwardly sloping inner surface to additionally lift the aircraft 10. A partial vacuum will tend to be formed adjacent to the upper surface of the wings 20 to further increase the lift imparted to the aircraft 10. The aircraft 10, which will continue to ascend until it reaches a hovering pattern and will fly in a substantially vertical path in the absence of a substantial wind. When wind is present, the aircraft 10 will move with the wind. The aircraft 10 will continue to hover until the charge of the power source 18 is insufficient to maintain altitude or until the aircraft 10 movement is controlled as will be discussed below.

After the charge of the power source 18 has been consumed, the motors 44 and 46 will stop operation and the propellers 48 and 50 will stop rotating. The aircraft 10 will then start to fall due to the action of gravity. As it falls, the aircraft 10 will remain upright because of the proximity of the motorized propulsion units 14 and 16 and the power supply 18. The aircraft 10 will then begin to rotate slowly in a counterclockwise direction, breaking the fall of the aircraft 10 and causing it to gently soar back down to the ground. The upward air current relative to the wings of the aircraft 10 causes the body 12 to rotate counterclockwise. The weight of the power supply 18 and motorized propulsion units 14 and 16 urge the aircraft 10 to remain upright.

The flight pattern of the aircraft 10 is controlled by adjusting the power supplied to each of the motors 44 and 46 from the power source 18. In this regard, varying the electric power supplied from the power source 18 to the electric motors 44 and 46 permits altitude and directional control of the aircraft 10. Altitude adjustment of the aircraft 10 is accomplished by simultaneously increasing or decreasing the speeds of the motors 44 and 46. Increasing the speed of the propellers 48 and 50 increases the lift and correspondingly causes the aircraft 10 to ascend. Analogously, decreasing the speed of the propellers 48 and 50 decreases the lift of the aircraft 10 and correspondingly causes the aircraft 10 to descend. The direction of the aircraft 10 can be changed by alternating the speed of one of the motors 44 or 46 relative to the other motor 44 or 46. The aircraft 10 generally operates with each motor 44 or 46 operating at a substantially equal speed. By momentarily increasing or decreasing the speed of one of the motors 44 or 46 produces a corresponding momentary increase or decrease in the lift provided by that motor. The directional control of the aircraft 10 will be discussed in greater detail below.

It is proposed by the present invention that flight patterns of the aircraft 10 can be controlled either by remote control or by programmed flight patterns. The embodiment of FIG. 1 depicts the aircraft 10 being remotely controlled by a controller 80. The controller 80 holds a handheld remote control unit 82 that is configured to emit an infrared control signal to be received by an infrared sensor 84 positioned on the central hub 22. In a preferred embodiment, the sensor 84 is positioned between 1 and 2 inches from the central axis extending through the center of the hub 22 so that it rotates at a relatively slow speed with respect to the rotation of the aircraft 10 in flight. More specifically, the sensor 84 is positioned on the central hub 22 opposite the motorized propulsion unit 16. As will be discussed in detail below, the remote control unit 82 includes a plurality of push button switches that when selectively activated cause an encoded modulated control signal to be transmitted towards the sensor 84 so as to operate the motors 44 and 46 in a desirable manner. In a preferred embodiment, the infrared sensor 84 includes two signal receivers, one on a top surface of the hub 22 (shown in FIGS. 1 and 3) and the other on a bottom surface of the hub 22 (not shown). This arrangement of the receivers allows for instant reaction of the motorized propulsion units 14 and 16 in response to the control signal. It will be appreciated by those skilled in the art that the remote control unit 82 can be designed to emit other types of control signals, such as radio frequency signals, to be received by an appropriate sensor on the aircraft 10.

The remote control unit 82 includes three switches (see FIG. 6) where upon activation of one of the switches, a frequency modulated control signal is generated that will cause the motorized propulsion units 14 and 16 to either increase, decrease or vary their respective speeds to cause the aircraft 10 to ascend, descend or turn. Particularly, if the controller 80 presses the ascend switch, the remote control unit 82 will transmit an ascend control signal that will be received by the sensor 84 and will cause the motorized propulsion units 14 and 16 to simultaneously increase their speeds so as to cause the aircraft 10 to ascend. Likewise, if the aircraft controller 80 presses the descend switch, the remote control unit 82 will transmit a descend control signal that will cause the motorized propulsion units 14 and 16 to simultaneously decrease their speeds so as to cause the aircraft 10 to descend. If the aircraft controller 80 presses the directional switch, the remote control unit 82 will transmit a modulated control signal that is received by the sensor 84 and will cause the motorized propulsion unit 16 to increase its speed so as to cause the aircraft 10 to move in a direction towards the position of the motorized propulsion unit 14 at a particular point in time. In other words, the directional modulated signal causes the aircraft 10 to experience a momentary increase in lift on the side opposite to the sensor 84. By directing the infrared beam from the remote control unit 82 to a specific location on the hub 22 of the aircraft 10, as the aircraft 10 rotates, the sensor 84 will eventually reach that location. When the sensor 84 intersects the beam from the remote control unit 82, the motorized propulsion unit 16 will temporarily and instantaneously increase its speed such that the aircraft 10 is caused to move in a direction away from the position of the beam on the hub 22. When the aircraft 10 is on the ground and is charged for flight, the aircraft controller 80 presses the ascend switch to give the aircraft 10 the initial power to gain flight. In one embodiment, the aircraft 10 will not respond to the descend switch or the directional switch when it is in a pro-launch position.

Directional control of the aircraft is more fully understood through example. As the aircraft 10 rotates throughout flight, each of the motorized propulsion units 14 and 16 continuously rotate through 360 degrees. For purposes of establishing a point of reference, it may be assumed that the motorized propulsion unit 16 is oriented direct south as the aircraft begins a rotation in a horizontal plane. In order to direct the aircraft 10 in a specified horizontal direction, for example northerly, the remote control is pointed on the south side of the aircraft 10 as it continuously rotates. The directional signal is received by the aircraft 10 as the aircraft 10 begins each new rotation. Instantaneously, the speed of the motorized propulsion unit 16 is increased, causing the aircraft 10 to translate northerly. The aircraft 10 can be similarly translated in any other direction. It will be appreciated by those skilled in the art, that alternatively, the aircraft can be controlled through horizontal translation by slowing the speed of the motorized propulsion unit 14 adjacent the sensor 84.

Figure 6:
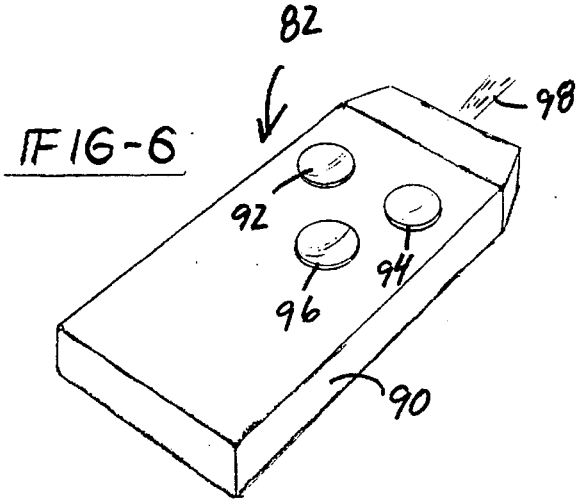
FIG. 6 is an enlarged perspective view of the remote control unit of the present invention.

A perspective view of the remote control unit 82 is shown in FIG. 6. The remote control unit 82 includes a housing 90 for enclosing the different circuit components associated with the unit 82. Three push button switches 92, 94 and 96 extending from a top surface of the housing 90 activate the remote control unit 82. By independently actuating one of the push button switches 92–96, an infrared light beam 98 will be emitted from a frosted light pipe (not shown) formed through the housing 90 to adjust the speed of one or both of the motors 44 and 46. Particularly, by actuating the switch 92, the light beam 98 will be encoded with a modulation frequency signal that will cause the motors 44 and 46 to rotate at a high speed so as to give the aircraft 10 lift. Actuation of the switch 94 will cause the light beam 98 to be encoded with a modulated frequency signal that will cause the motors 44 and 46 to rotate at a slow speed so as to decrease the altitude of the aircraft 10. Actuating the switch 96 will cause the light beam 98 to be encoded with a modulated frequency signal that will cause the motor 44 to rotate at a higher speed than the motor 46 so as to cause the aircraft 10 to either bank Deft, bank right or fly towards the operator 80 of the remote control unit 82. The operation of the remote control unit 82 will be discussed in greater detail below.

Figure 7:
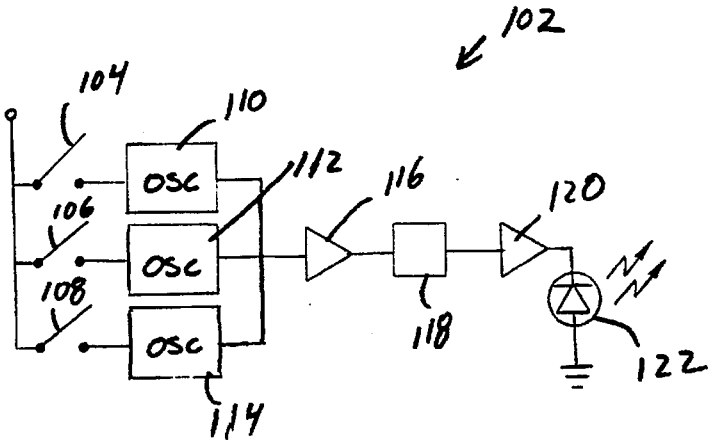
FIG. 7 is a schematic diagram of the remote controller of the preferred embodiment of the present invention.

In one embodiment, the motors 44 and 46 will only continue providing lift to the aircraft 10 when the sensor 84 is receiving the light beam 98 signal from the control unit 82. For example, say that the ascend switch 92 is activated for a predetermined period of time so as to launch the aircraft 10. If the operator 80 releases the ascend switch 92, the motors 44 and 46 will continue to operate at a high speed for approximately one second after the switch 92 is released. After that time, and assuming the switches 92-96 are not activated, the motors 44 and 46 will progressively receive less power until approximately two seconds after the one second interval, at which time the motors 44 and 46 will receive zero power. If the operator 80 does not take steps to reactivate the motors 44 and 46, the aircraft 10 will rotate safely to earth under no power. The operation of how the motors 44 and 46 receive power will be discussed in more detail below. In one embodiment, the control unit 82 has a transmitting range of about 300 feet, A schematic diagram of a control circuit 102 enclosed within the housing 90 of the remote control unit 82 is shown in FIG. 7. The control circuit 102 includes a first switch 104, a second switch 106 and a third switch 108 intended to represent each of the push button switches 92, 94 and 96, respectively, discussed above. A series of three oscillator circuits 110, 112 and 114 are connected to the switches 104, 106 and 108, respectively. When one of the switches 104, 106 or 108 is actuated, power is provided to the respective oscillator circuit 112, 114 or 116 in order to generate an oscillation signal. In one embodiment, the oscillator circuit 110 oscillates at a center frequency of 1 kHz, the oscillator circuit 112 oscillates at a center frequency of 1.1 kHz, and the oscillator circuit 114 oscillates at a center frequency of 1.2 kHz in order to distinguish and separate each switch 104, 106 and 108. In order to provide an acceptable difference between the oscillation frequencies of the oscillator circuits 110, 112 and 114 for the purposes described herein, it is necessary that each of the center frequencies of the oscillator circuits 110, 112 and 114 be at least 100 Hz apart. However, each of the center frequencies of the oscillator circuits 110, 112 and 114 can be between the frequencies of 1 kHz and 20 kHz.

Depending on which of the switches 104, 106 and 108 is actuated, the appropriate oscillator circuit is activated and the corresponding oscillation signal is provided to an integrating amplifier circuit 116. The integrating amplifier circuit 116 amplifies the oscillation signal from the activated oscillator circuit and applies this signal to a modulator circuit 118. The modulator circuit 118 generates a high frequency carrier wave to transmit the particular frequency signal from the oscillator circuits 110, 112 and 114. In one embodiment the modulation carrier frequency is 40 kHz. The particular oscillation frequency signal from the oscillator circuits 110, 112 and 114 is modulated by the modulator circuit 118 and is applied to a second amplifier circuit 120. The amplified signal from the amplifier circuit 120 is then applied to a photodiode 122 which transmits an infrared signal having the frequency modulated signal. The infrared signal is transmitted down the light pipe in a collimated format as the light beam 98. Therefore, depending on whether you want the aircraft 10 to go up, go down or change direction, activation of the appropriate switch 104, 106 or 108 will transmit the appropriate signal.

Figure 8:
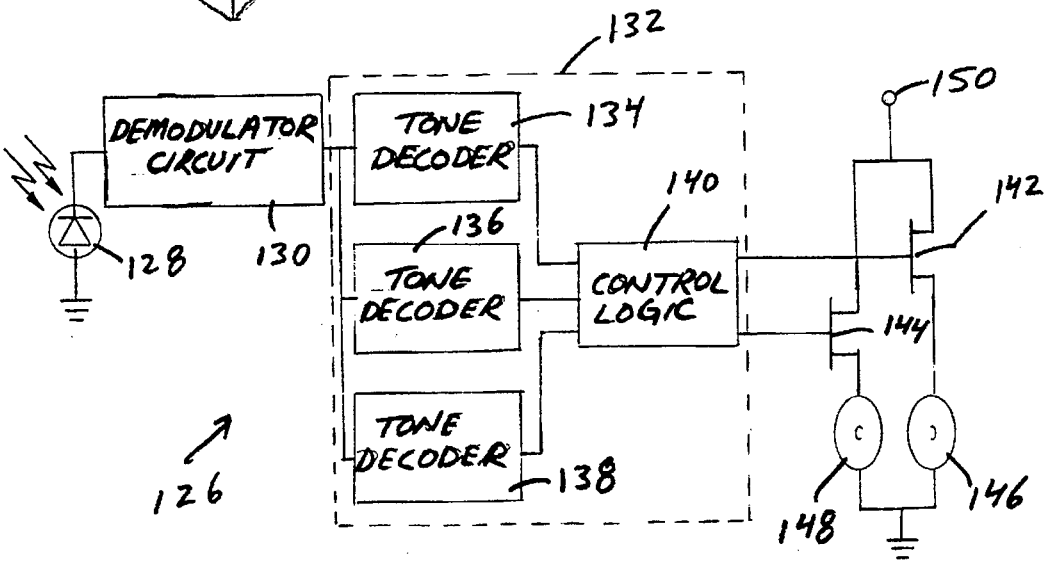
FIG. 8 is a schematic diagram of the receiver circuit of the preferred embodiment of the present invention.

FIG. 8 shows a schematic block diagram of a control circuit 126 that is operable to adjust the speed of the motors 44 and 46 of the aircraft 10 in the manner as described above upon receipt of the appropriate signal from the remote control unit 82. The control circuit 126 includes a photosensitive PIN diode 128 that is sensitive to the infrared signal transmitted by the remote control unit 82. The photodiode 128 provides an electrical signal at a frequency indicative of the transmitted infrared light beam 98 to a demodulator circuit 130. In one embodiment, the demodulator circuit 130 is a commercially available circuit referred to in the art as an NEC 3T07 integrated chip. The demodulator circuit 130 removes the carrier wave from the frequency modulated signal and sends the modulated signal to a microcontroller 132. The microcontroller 132 is a commercially available controller such as the Motorola 68051 integrated chip manufactured by Sony. The microcontroller 132 includes three tone decoder circuits 134, 136 and 138 where each decoder circuit is tuned to detect one of the center frequencies of the oscillator circuits 110, 112 and 114. For example, the tone decoder circuit 134 is tuned to a center frequency of 1 kHz to detect the oscillation frequency from the oscillator circuit 110, the tone decoder circuit 136 is tuned to a center frequency of 1.1 kHz to detect the oscillation frequency from the oscillator circuit 112, and the tone decoder circuit 138 is tuned to a center frequency of 1.2 kHz to detect the oscillation frequency of the oscillator circuit 114. Therefore, the control circuit 126 will determine which switch 110, 112 or 114 has been activated by the tone decoder circuits 134, 136 and 138 as just described. In one embodiment, the tone decoder circuits 134, 136 and 138 are phase locked loop circuits commercially available as integrated circuit part No. 567 from National Semiconductor. Depending on which tone decoder circuit 124, 126 or 128 is activated by the incoming signal, a signal from that tone decoder circuit will be applied to a control logic circuit 140 of the microcontroller 132. Depending on which input line to the control logic circuit 140 is activated, the control logic circuit 140 will output an appropriate signal on a pair of output lines that are connected to the gate terminals of a first power field effect transistor (FET) 142 and a second power FET 144. In one embodiment, the FETs 142 and 144 are 10 amp n-channel FETs. The signal from the control logic circuit 140 applied to the FETs 142 and 144 is a pulse width modulation (PWM) signal having a particular duty cycle that defines the width of each pulse in the signal. Such a PWM signal can be programmed in software to be generated an output port of the control logic circuit 140, as would be well understood to one skilled in the art. The control logic circuit 140 applies either a high or low PWM signal to the gate terminals of the FETs 142 and 144. The PWM signal on the gate terminals of the FETs 142 and 144 will control the amount of voltage being applied to motors 146 and 148, respectively, from a power input terminal 150. The motors 146 and 148 are representative of the motors 44 and 46 discussed above. Specifically, a PWM signal having a high duty cycle applied to the gate terminal of the FET 142 will cause a high voltage potential to be applied to the motor thus allowing the motor 146 to operate at a high speed. Likewise, a PWM signal having a low duty cycle applied to the gate terminal of the FET 142 will cause a small voltage potential to be applied to the motor 146, thus operating the motor 146 at a slow speed. Therefore, by applying the appropriate high or low PWM signals to the FETs 142 and 144, the motors 146 and 148 will operate at a slow or fast speed. The pulse width of the PWM signal from the control logic circuit 140 would be programmed in the software of the circuit 140. As mentioned above, when no signal is being received by the aircraft 10 from the control unit 82, the previous PWM signal will be maintained for approximately one second, and then the duty cycle of the PWM signal will begin to decrease until no signal is applied to the FETs 142 and 144. For the embodiment described above, only one of the motors 146 or 148 is switched to a high speed to provide directional maneuvering. The operation of the demodulator circuit 130, the tone decoder circuits 134, 136 and 138, and the control logic circuit 140 as just described would be well understood to one skilled in the art.

Figure 9:
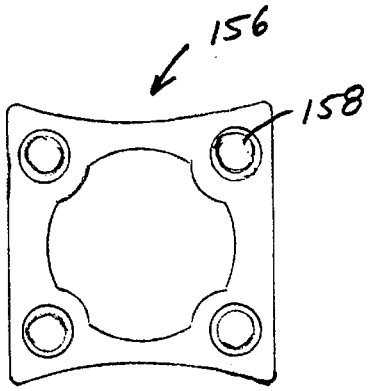
FIG. 9 is a front view of a switch mechanism for activating a preprogrammed flight pattern.

In an alternate embodiment, the remote control aspect of controlling the aircraft 10 is eliminated and the flight pattern of the aircraft 10 is controlled by a preprogrammed sequence of maneuvers. In this embodiment, activation of a particular function switch prior to the aircraft 10 lifting off for flight will cause the power to the motors 44 and 46 to be controlled by a microcontroller, or other suitable controlling mechanism, such that the aircraft 10 will follow the predetermined flight pattern depending on the function switch that is activated. FIG. 9 shows a switch mechanism 156 that is to be mounted on the hub 22 of the aircraft 10 at an appropriate location. In a preferred embodiment, the switch mechanism 156 is secured to a bottom central location of the hub 22 by any suitable securing means. The switch mechanism 156 includes a series of push button function switches 158 as shown. In this embodiment, there are four function switches 158 that are independently activated to cause the aircraft 10 to follow one of four flight patterns. Of course, any suitable number of function switches can be provided to provide differing numbers of preprogrammed flight patterns.

Figure 10:
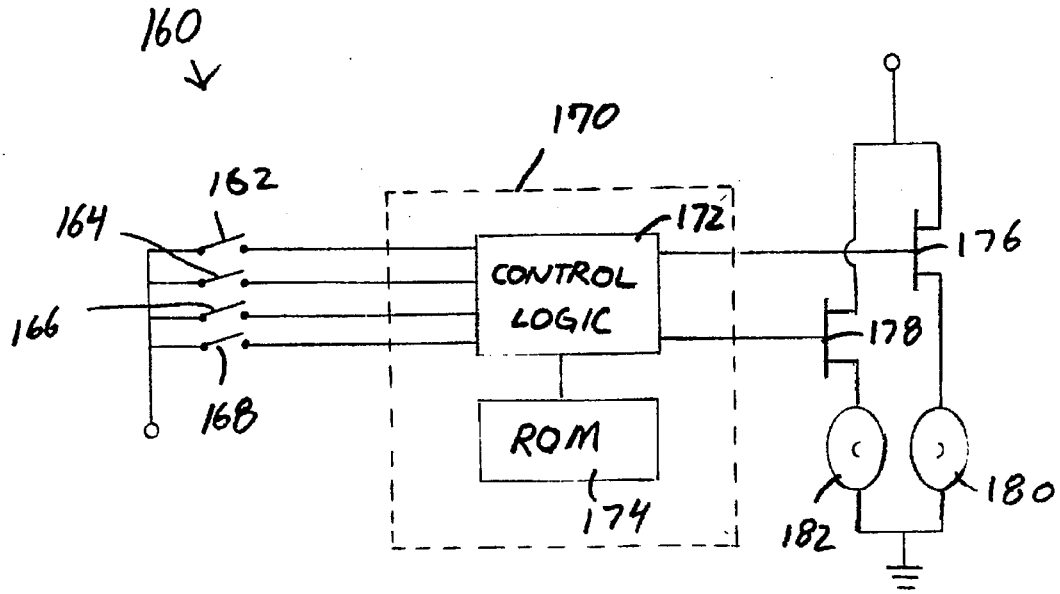
FIG. 10 is a schematic diagram of a control circuit for preprogrammed flight according to an embodiment of the present invention.

FIG. 10 shows a control circuit 160 that depicts how the aircraft 10 is controlled by the preprogrammed flight patterns. A series of four switches 162, 164, 166 and 168 represent the four function switches 158 of the switch mechanism 156. When one of the switches 162–168 is activated, a signal on a particular input line is applied to a microcontroller 170. The microcontroller 170 is also a commercially available microcontroller and can also be the Motorola 6805K1 integrated chip as discussed above. The signal from one of the switches 162–168 is applied to a control logic circuit 172 as an input within the microcontroller 160. When the control logic circuit 172 receives a signal on one of the input lines from the switches 162–168, the control logic circuit 172 will access a particular flight pattern stored in software in a read only memory (ROM) 174. Depending on the preprogrammed flight pattern stored in the ROM 174, the control logic circuit 172 will cause appropriate PWM signals to be applied to the gate terminals of a pair of power FETs 176 and 178 as shown. The FETs 176 and 178 are electrically connected to a corresponding motor 180 and 182 as shown. The control logic circuit 172 controls the operation of the motors 180 and 182 through the FETs 176 and 178 in the same manner as the control logic circuit 140 controls the motors 146 and 148 as discussed above. The difference is that in the embodiment of FIG. 8, one of the switches 162–168 is activated once to cause the control logic circuit 172 to activate a flight plan stored in the ROM 174 to cause the aircraft 10 to perform a number of connected maneuvers.

Because the aircraft 10 is symmetrical in nature, and is powered by the two motorized propulsion units 14 and 16 that do not lie on the axis of symmetry, stability of the aircraft 10 in flight could be a concern. If the motors 44 and 46 are operating at different speeds when the aircraft 10 is ascending or descending, the instability of the aircraft 10 may cause the aircraft 10 to follow a general helix pattern. It may be desirable then to include some mechanism for maintaining the speed of the motors 44 and 46 substantially constant when the aircraft 10 is being caused to ascend or descend.

Figure 11:
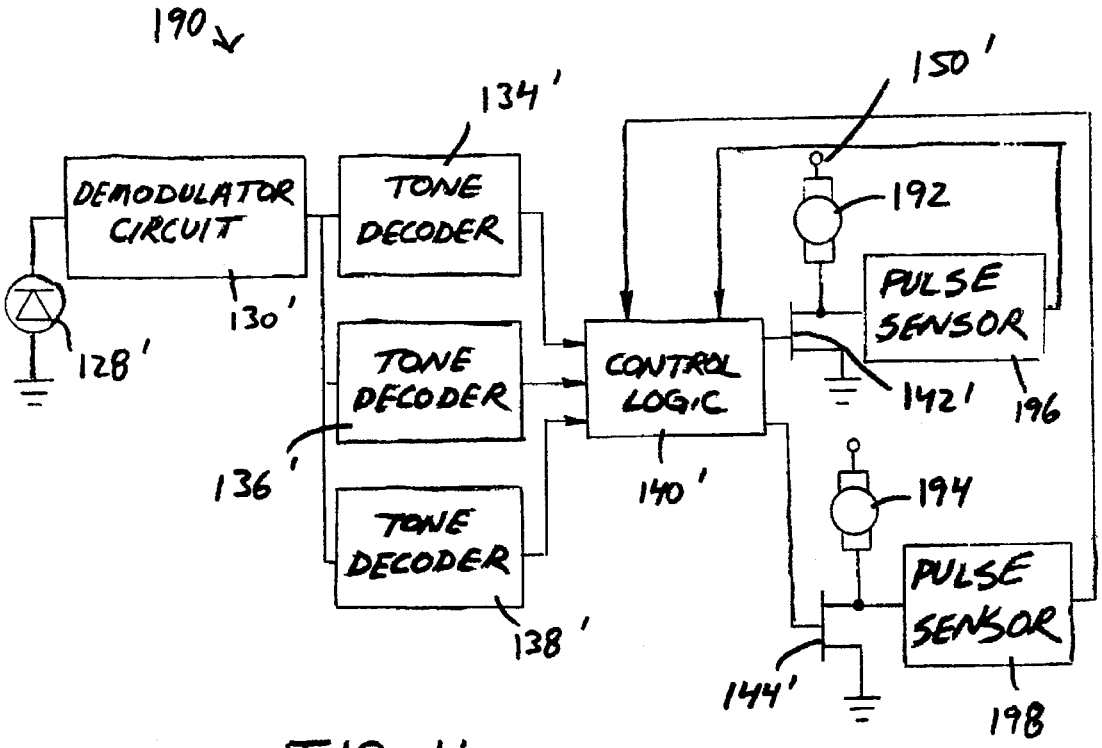
FIG. 11 is a schematic diagram of a receiver circuit for another embodiment of the present invention.

FIG. 11 shows a schematic block diagram of a control circuit 190 that is operable to adjust the speed of the motors 44 and 46 to be substantially the same when the aircraft is being caused to ascend or descend. The control circuit 190 includes the same components as the control circuit 126, discussed above, and are labeled accordingly with a prime. In this example, however, the motor 146 is shown as a motor 192 and the motor 148 is shown as a motor 194. A PWM signal applied to the gate terminals of the FETs 142' and 144' control the voltage being applied to the motors 192 and 194 in the same manner as the control logic circuit 140 controlled the voltage being applied to the motors 146 and 148. In the embodiment of FIG. 11, the motor 192 is connected between the power terminal 150' and the drain terminal of the FET 142' instead of the motor 192 being connected between the source terminal of the FET 142' and ground as with the motor 146 above. The motor 194 is electrically connected in an identical fashion. However, the principle of applying the PWM signal to control the speed of the motors 192 and 194 is the same as above.

In order to cause the motors 192 and 194 to operate at a substantially identical speed during the times when the aircraft 10 is ascending and descending, a pulse sensor 196 and a pulse sensor 198 are provided. The pulse sensor 196 detects the pulses that are generated by the armature windings (not shown) associated with the armature (not shown) of the motor 192 rotate. In other words, as the motor 192 rotates, the armature windings will continually be making and breaking contact with commutator segments (not shown) that deliver the power to the armature windings to cause them to rotate. The operation of a DC electric motor of this type would be well understood to one skilled in the art. The pulse sensor 196 detects these pulses, and provides this pulsed signal to the control logic circuit 140'. The pulse sensor 198 provides the same pulse signal to the control logic circuit 140' for the motor 194. The control logic circuit 140' compares the phase of the pulses from each of the pulse sensors 196 and 198 to determine if they are in phase within a predetermined tolerance. If the phase of the pulses from the motors 192 and 198 do not substantially coincide, the control logic circuit 140' will alter the PWM signal being applied to one of the FETs 142' or 144' to decrease or increase the speed of the corresponding motor 192 and 194 so as to cause the pulses of that motor to be adjusted in a desirable manner. Therefore, the motors 192 and 194 will be substantially operating at the same speed for stable flight.

Figure 12:
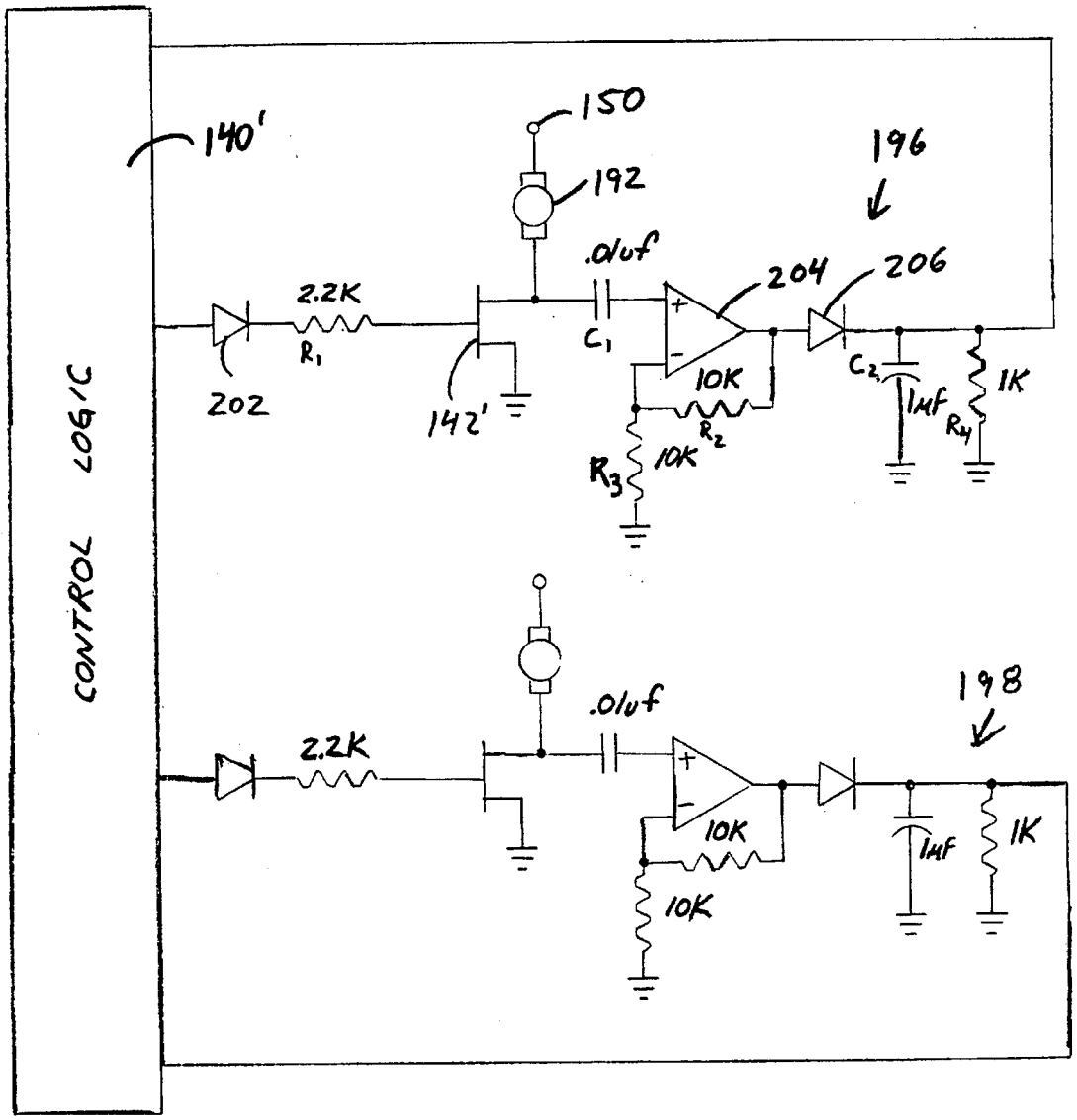
FIG. 12 is a detailed schematic diagram of pulse sensors associated with the receiver circuit of FIG. 11.

FIG. 12 shows a detailed schematic view of the pulse sensors 196 and 198 as shown. Because the pulse sensors 196 and 198 are identical, only the pulse sensor 196 will be described with the understanding that the pulse sensor 198 operates in the same manner. The PWM signal is applied to the gate terminal of the FET 142' through a rectifying diode 202 and a 2.2K limiting resistor $R_1$. The motor 192 will operate at the speed depending on the duty cycle of the PWM signal applied to the FET 142'. As the meter 192 turns, pulses created by the contact of the armature windings with the commutator segments in the motor 192 create a pulse signal as a result of the opening and closing of the circuit between the terminal 150' and ground through the FET 142'. The pulse signal is applied to a 0.01 μf capacitor $C_1$ in order to generate sharp transitions of the edges of the pulses in the signal. The pulse signal is then applied to the positive terminal of an operational amplifier 204 to be amplified. A 10K feed resistor $R_2$ between the output of the operational amplifier 204 and the negative terminal of the operational amplifier 204 and a 10 k lead resistor $R_3$ between the negative terminal of the operational amplifier 204 and ground establishes the gain of the amplifier 204. The amplified pulse signal at the output of the amplifier 204 is applied to a rectifying diode 206. A 1 μf capacitor $C_2$ and a 1K resistor $R_4$ filter the pulse signal so that a clean pulse signal is applied to the control logic circuit 140'. The control logic circuit 140' determines the timing between a falling edge of one pulse and a leading edge of a next pulse for both the pulse sensors 196 and 198 to determine if they are in phase with each other. If the pulse signals are not in phase, the control logic circuit 140' adjusts the PWM signal being applied to one of the FETs 142' and 144' so as to affect the speed of the motor 192 or 194 until the pulse signals are in phase. In this manner, the motors 44 and 46 will operate at substantially the same speed when the aircraft 10 is being commanded to ascend or descend.

While a preferred embodiment of the invention has been described and certain modifications thereto suggested, it will be recognized by those skilled in the art that other changes may be made to the above-described embodiments in the invention without departing from the broad, inventive concepts thereof. It should be understood, therefore, that the invention is not limited to the particular embodiments disclosed but covers any modifications which are within the scope and spirit of the invention as defined by the appended claims.

What is claimed is:

1. A toy aircraft consisting essentially of:

a main body portion extended central hub member having a plurality of wings equally spaced about a central axis of rotation, said wings extending outwardly from said hub member, a protective cover for said central hub member and a power source housed within said protective cover;

at least one motorized propulsion unit interconnected with said power source; and at least first and second propeller assemblies interconnected to and powered by said at least one motorized propulsion unit, said propeller assemblies driven for rotation in a normally horizontal plane where said assemblies are mounted adjacent ends of said extended hub member, said first and second propeller assemblies each including a plurality of blades;

control means being one of remote control means and on-board preprogrammed control means for controlling said propeller assemblies thereby providing for control of said aircraft;

whereby rotation of the blades of said first and second propeller assemblies in a first direction provides a primary source of lift to the aircraft directly from air displaced by said blades while a secondary source of lift to the aircraft results from rotation of said hub member and wings in a second direction about said central axis of rotation.

2. The toy aircraft of claim 1, wherein said plurality of blades of said first and second propeller assemblies rotate in a substantially horizontal plane.

3. The toy aircraft of claim 1, wherein each wing of said plurality of wings includes a convex upper surface and a concave lower surface.

4. The toy aircraft of claim 1, wherein at least a portion of each wing of said plurality of wings is inclined at an angle of between approximately 30 degrees to 45 degrees with respect to a horizontal plane.

5. The toy aircraft of claim 1, wherein said plurality of wings is two wings.

6. The toy aircraft of claim 5, wherein each wing of said two wings includes a central longitudinal axis, said central longitudinal axes of said two wings being disposed relative to one another in a parallel, spaced apart relationship.

7. The toy aircraft of claim 6, wherein each motorized propulsion unit of said at least one motorized propulsion unit is axially spaced apart from each wing of said plurality of wings.

8. The toy aircraft of claim 1, wherein said at least first and second propeller assemblies each include:

a propeller shaft; and a rotatable member including said plurality of blades equally spaced about an axis of rotation defined by said propeller shaft, each of said plurality of blades being formed from foamed polystyrene.

9. The toy aircraft of claim 1, wherein each of said plurality of blades includes a convex upper surface and a concave lower surface.

10. The toy aircraft of claim 1, wherein each of said plurality of blades includes a leading surface and a trailing edge surface, said trailing edge surface being generally arcuate.

11. The toy aircraft of claim 10, wherein each leading edge surface is substantially linear.

12. The toy aircraft of claim 8, wherein two blades are interconnected to said propeller shaft, said two blades being diametrically opposed from one another about said central axis.

13. The toy aircraft of claim 8, wherein said rotatable member is integrally unitarily formed.

14. The toy aircraft of claim 8, wherein each of said plurality of blades are peripherally interconnected by an arcuate ring.

15. The toy aircraft of claim 8, further comprising a cage member including a generally cylindrical portion peripherally enclosing the each of said plurality of blades.

16. The toy aircraft of claim 15, wherein said cage member further includes an upper and lower grate portion which permits flow of a source of air past said plurality of blades in a direction substantially perpendicular to a plane defined by said plurality of blades.

17. The toy aircraft of claim 1, wherein each wing of said plurality of wings includes a central longitudinal axis, said central longitudinal axes of said plurality of wings being disposed relative to one another in a parallel, spaced apart relationship.

18. The toy aircraft of claim 17, wherein said at least one motorized propulsion unit is two motorized propulsion units, and further wherein said two motorized propulsion units are mounted at opposite ends of a central housing attached to said central hub member, said central housing being disposed substantially perpendicular to said central longitudinal axes of said plurality of wings.

19. The toy aircraft of claim 1, wherein said plurality of blades is formed from foamed polystyrene.

20. The toy aircraft of claim 1, wherein each of said plurality of blades is peripherally interconnected by an arcuate ring.

21. The toy aircraft of claim 1, further comprising:

a cage member including a generally cylindrical portion peripherally enclosing each of said plurality of blades, said cage member further including an upper and lower grate portion which permits flow of a source of air past said plurality of blades in a direction substantially perpendicular to a plane defined by said plurality of blades.

22. A toy aircraft adapted for untethered flight, the toy aircraft consisting essentially of:

a main body portion extended central hub member having first and second wings equally spaced about a central axis of rotation extending therefrom, a protective cover for said central hub member and a power source housed within said protective cover;

means for controlling the flight of the aircraft being one of remote control means and on-board preprogrammed control means;

first and second motorized propulsion units interconnected with said power source; and first and second propeller assemblies interconnected to said first and second motorized propulsion units and mounted adjacent ends of said hub member, respectively, said first and second propeller assemblies each including a plurality of blades arranged for rotation within a substantially horizontal plane;

whereby rotation of said blades of said first and second propeller assemblies in a first direction within a substantially horizontal plane provides a primary source of lift to the aircraft directly from air displaced by said blades and a secondary source of lift to the aircraft from rotation of said blades causing rotation of said main body portion extended central hub member with said wings in a second rotary direction about said central axis of rotation.

23. The toy aircraft of claim 22, wherein each wing of said wings includes a central longitudinal axis, said central longitudinal axes of said wings being disposed relative to one another in a parallel, spaced apart relationship.

24. The toy aircraft of claim 22, wherein said plurality of blades is formed from foamed polystyrene.

25. The toy aircraft of claim 24, further comprising a cage member including a generally cylindrical portion peripherally enclosing each of said plurality of blades, said cage member further including an upper and lower grate portion which permits flow of a source of air past said plurality of blades in a direction substantially perpendicular to a plane defined by said plurality of blades.

26. The toy aircraft of claim 22, wherein said first and second motorized propulsion units are mounted at opposite ends of a central housing attached to said central hub member, said central housing being disposed substantially perpendicular to said central longitudinal axes of said wings.

27. A toy aircraft comprising:

a main body portion including a central hub member and first and second wings, each wing of said first and second wings being equally spaced about a central axis of rotation, each wing of said first and second wings includes a central longitudinal axis, said central longitudinal axes of said first and second wings being disposed relative to one another in a parallel, spaced apart relationship;

a power source carried by the aircraft;

two motorized propulsion units interconnected with said power source, said two motorized propulsion units are mounted at opposite ends of a central housing attached to said central hub member, said central housing being disposed substantially perpendicular to said central longitudinal axes of said wings; and at least first and second propeller assemblies interconnected to said two motorized propulsion units, said first and second propeller assemblies each including a plurality of blades;

whereby rotation of said blades of said first and second propeller assemblies provides a primary source of lift to the aircraft directly from air displaced by said blades and a secondary source of lift to the aircraft from the angular momentum of said blades which causes rotation of said main body portion about said central axes of rotation.

28. A toy aircraft adapted for untethered flight, the toy aircraft comprising:

a main body portion including a central hub member and first and second wings, each wing of said first and second wings being equally spaced about a central axis of rotation, each wing of said wings includes a central longitudinal axis, said central longitudinal axes of said wings being disposed relative to one another in a parallel, spaced apart relationship;

a power source carried by the aircraft;

first and second motorized propulsion units interconnected with said power source, said first and second motorized propulsion units are mounted at opposite ends of a central housing attached to said central hub member, said central housing being disposed substantially perpendicular to said central longitudinal axes of said wings; and first and second propeller assemblies interconnected to said first and second motorized propulsion units, respectively, said first and second propeller assemblies each including a plurality of blades arranged for rotation within a substantially horizontal plane;

whereby rotation of said blades of said first and second propeller assemblies within a substantially horizontal plane provides a primary source of lift to the aircraft directly from air displaced by the blades and a secondary source of lift to the aircraft from the angular momentum of said blades which causes rotation of said main body portion about said central axis of rotation.

* * * * *